US011913199B2

(12) United States Patent
Ross

(10) Patent No.: US 11,913,199 B2
(45) Date of Patent: Feb. 27, 2024

(54) FLUSHING STATION

(71) Applicant: Uponor Innovation AB, Virsbo (SE)

(72) Inventor: Andreas Ross, Haßfurt (DE)

(73) Assignee: Uponor Innovation AB, Virsbo (SE)

( * ) Notice: Subject to any disclaimer, the term of this patent is extended or adjusted under 35 U.S.C. 154(b) by 41 days.

(21) Appl. No.: 17/687,509

(22) Filed: Mar. 4, 2022

(65) Prior Publication Data

US 2022/0290415 A1 Sep. 15, 2022

(30) Foreign Application Priority Data

Mar. 9, 2021 (DE) ..... 102021105677.2

(51) Int. Cl.

| | |
|---|---|
| ***E03B 7/00*** | (2006.01) |
| ***E03C 1/05*** | (2006.01) |
| ***E03C 1/10*** | (2006.01) |
| ***E03C 1/24*** | (2006.01) |
| ***F24D 17/00*** | (2022.01) |

(52) U.S. Cl.

CPC ..... *E03B 7/006* (2013.01); *E03C 1/057* (2013.01); *E03C 1/10* (2013.01); *E03C 1/24* (2013.01); *F24D 17/0073* (2013.01); *E03C 2001/2406* (2013.01)

(58) Field of Classification Search

CPC ... E03B 7/006; E03B 7/08; E03C 1/10; E03C 1/242; E03C 1/244

See application file for complete search history.

(56) References Cited

U.S. PATENT DOCUMENTS

| | | | | |
|---|---|---|---|---|
| 2,045,479 | A * | 6/1936 | Luff | E03C 1/10 137/216 |
| 4,604,202 | A * | 8/1986 | Movshovitz | B01D 35/02 210/433.1 |
| 2012/0234398 | A1* | 9/2012 | Leymann | E03B 7/08 137/15.05 |
| 2017/0241112 | A1* | 8/2017 | Bartenstein | E03B 7/08 |
| 2017/0241113 | A1* | 8/2017 | Bartenstein | E03B 7/08 |
| 2019/0368169 | A1* | 12/2019 | Arens | E03D 1/00 |
| 2022/0162840 | A1* | 5/2022 | Hausmann | E03B 7/08 |

FOREIGN PATENT DOCUMENTS

| | | | |
|---|---|---|---|
| AT | 507052 | A1 | 1/2010 |
| DE | 102011013955 | A1 | 9/2012 |
| DE | 202013102154 | U1 | 8/2014 |
| DE | 202014007233 | U1 | 12/2015 |
| DE | 102015113886 | A1 | 2/2017 |

(Continued)

*Primary Examiner* — Reinaldo Sanchez-Medina

(74) *Attorney, Agent, or Firm* — Haynes Beffel & Wolfeld LLP; Andrew L. Dunlap; Jason Liao

(57) ABSTRACT

A flushing station is provided. The flushing station includes a connection piece for a hot water pipe, a connection piece for a cold water pipe, a collecting tank with a siphon for draining the water, pipes at the connection pieces which conduct the water from the connection pieces into the collecting tank at least one sensor per pipe a control unit connected to the sensor, a valve actuatable in the pipes, wherein the control unit is coupled to the actuatable valve and the actuatable valve can be opened by the control unit for flushing the hot or cold water pipe. According to the invention, a flow restrictor and a flow straightener are integrated in each of the pipes.

14 Claims, 11 Drawing Sheets

(56) References Cited

FOREIGN PATENT DOCUMENTS

| | | | |
|---|---|---|---|
| DE | 202016100853 | U1 | 5/2017 |
| DE | 102017111074 | A1 | 11/2018 |
| DE | 102019105614 | A1 | 9/2020 |
| EP | 2500475 | A2 | 9/2012 |
| GB | 2264051 | A | 8/1993 |

* cited by examiner

FLUSHING STATION

RELATED APPLICATION

This application claims priority to German application No. 102021105677.2, filed Mar. 9, 2021, which is incorporated by reference herein.

BACKGROUND

This invention relates to a flushing station for flushing hot or cold water pipes.

BRIEF DESCRIPTION

The invention relates to a flushing station comprising a connection piece for a hot water pipe, a connection piece for a cold water pipe, a collecting tank with a siphon for draining the water, pipes at the connection pieces which conduct the water from the connection pieces into the collecting tank, at least one sensor, a control unit connected to the sensor, a valve actuatable in the pipes, wherein the control unit is coupled to the actuatable valve and the actuatable valve can be opened by the control unit for flushing the hot or cold water pipe.

Flushing stations are necessary to prevent the formation of *legionella* or germs in water that has been standing for a long time. *Legionella* is a serious health risk, especially for elderly or immunocompromised people. All operators or landlords of commercial buildings have the obligation to ensure hygienically safe water. Therefore, flushing stations are usually installed in new commercial buildings. The disadvantage of the flushing stations known to date is the relatively high noise emission during the flushing process.

The invention is therefore based on the object of demonstrating a solution by which this noise emission is reduced.

According to the invention, this object is achieved by integrating a flow restrictor and a flow straightener in each of the pipes.

The flow restrictor limits the amount of water and the flow straightener creates a laminar flow.

This reduces noise emissions to such an extent that the limit values of DIN 4109 and VDI 4100 are complied with.

According to a preferred embodiment, the flow restrictor reduces the flow rate to 16 liters per minute and the flow straightener reduces the flow rate to 15 liters per minute and further effects a laminar flow in the pipe.

The advantage here is that the flow restrictor is arranged upstream of the flow straightener in the flow direction, so that the water to be flushed is conducted into the collecting tank with a laminar flow.

According to a further advantageous embodiment, the valve is designed as a ball valve. Ball valves do not have a tendency to "water hammering", i.e. a pressure surge or water hammer effect, which would lead to vibration and high noise emission.

According to a further preferred embodiment, the flushing station has a housing made of expanded polypropylene, from which only the connection pieces are led out. The complete encapsulation of the flushing station achieves a further noise reduction.

Further advantageous embodiments are disclosed in the subclaims and in the following description of the figures.

The invention is explained in more detail below with reference to an exemplary embodiment illustrated in the figures.

In the following, elements of the same function are given the same reference signs in the figures and are not explained separately in each case.

DETAILED DESCRIPTION

Figure 1:
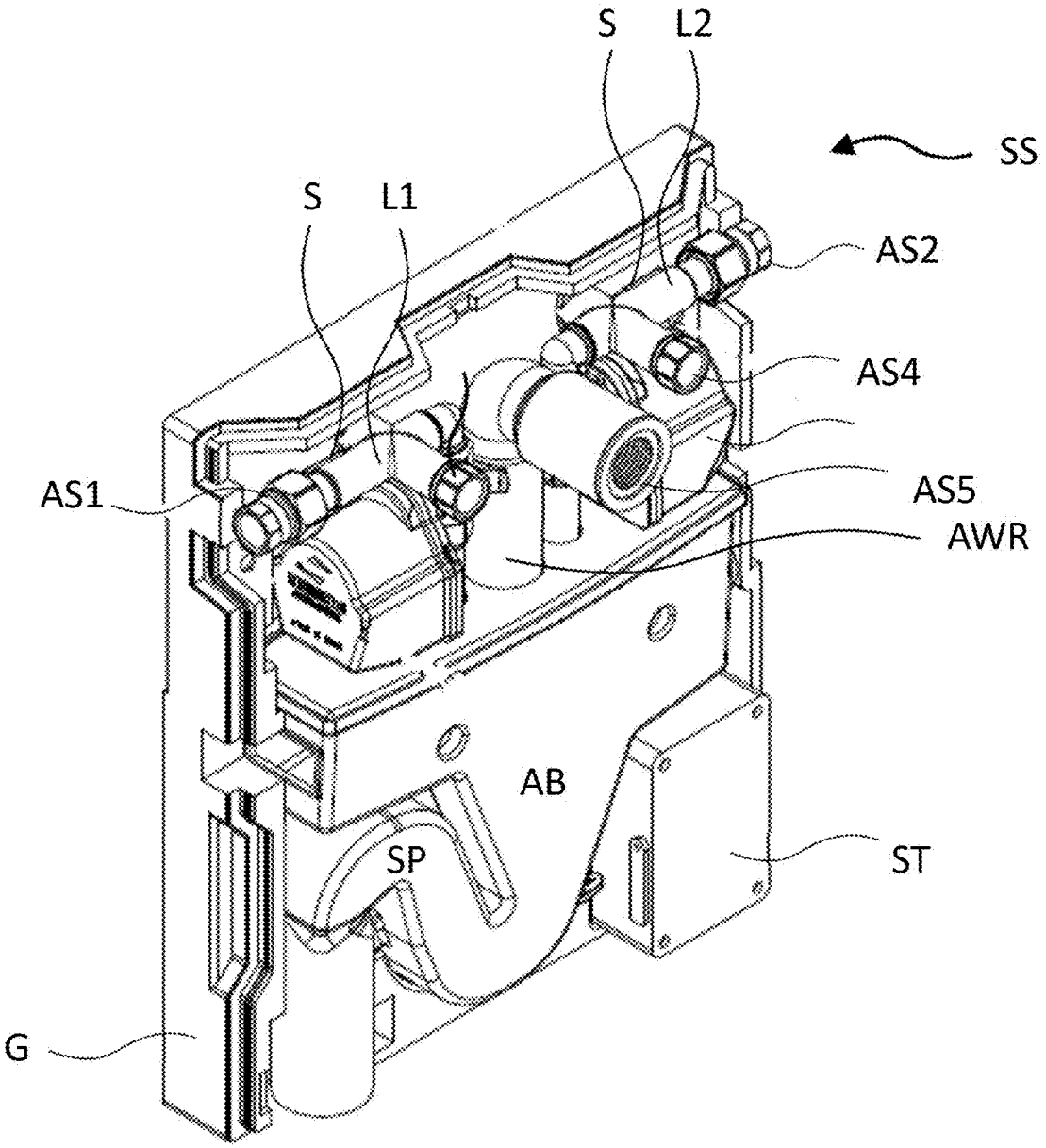
FIG. 1 shows an oblique view of an opened flushing station according to the invention.

FIG. 1 shows an oblique view of an opened flushing station SS, which comprises a connection piece AS1 for a hot water pipe and another connection piece AS2 for a cold water pipe. The connection pieces are formed on pipes L1 and L2, respectively, inside the flushing station, which conduct the water downward into a collecting tank AB.

The connection pieces AS1 and AS2 designate the purely functional connections to the hot and cold water pipes. In the exemplary embodiment shown, the connection pieces are realized by a union nut and an adapter piece. Any other implementation, such as an internal thread or a quick-connection technique, would also be possible.

From the collecting tank AB, the water is drained downwards out of the flushing station via a siphon SP into a drain pipe.

The pipes L1 and L2 also have connection pieces AS3 and AS4 for connecting the hot water connection and cold water connection of a wash basin, respectively.

Furthermore, a wastewater pipe AWR with a connection piece AS5 is provided in the flushing station SS, to which the drain of a wash basin can be connected. The wastewater pipe also opens into the collecting tank AB.

The flushing station SS also has a control unit ST, which can open the pipes L1 and L2 via electronically operated valves V for flushing the hot and cold water pipes, respectively.

Sensors S are attached to the pipes L1 and L2, which are connected to the control unit ST and which can measure whether or not water is flowing in the pipes L1 or L2. After a preset period of time in which the sensors S measure that no water is flowing, the control unit ST, which in turn is connected to the electronically actuatable valves V, causes the pipes L1 and L2, and thus the hot and cold water pipes connected to them, to be flushed by opening the valves V.

The flushing station SS has a housing G which is made of expanded polypropylene. Only the rear part of the housing G is shown in FIG. 1.

Figure 2:
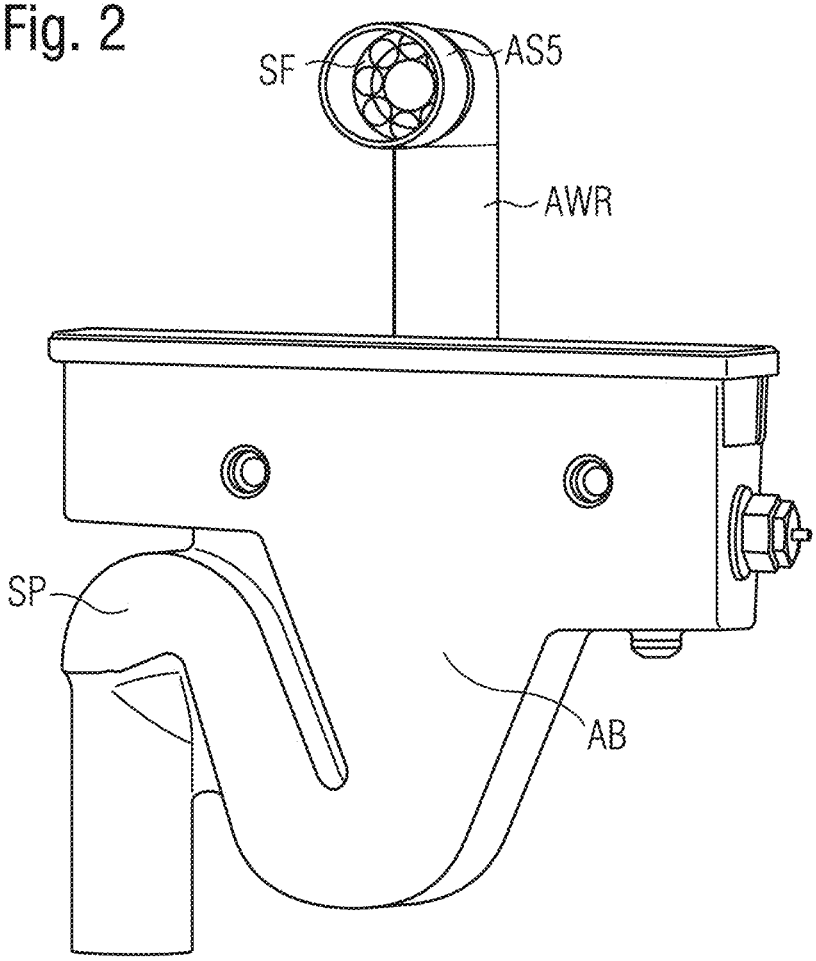
FIG. 2 shows parts of the flushing station.

FIG. 2 shows in isolation the collecting tank AB of the flushing station SS and the siphon SB, which is formed in one piece with the collecting tank AB. Also shown is the wastewater pipe AWR with a connection piece AS5, in which a dirt trap SF is integrated.

Figure 3:
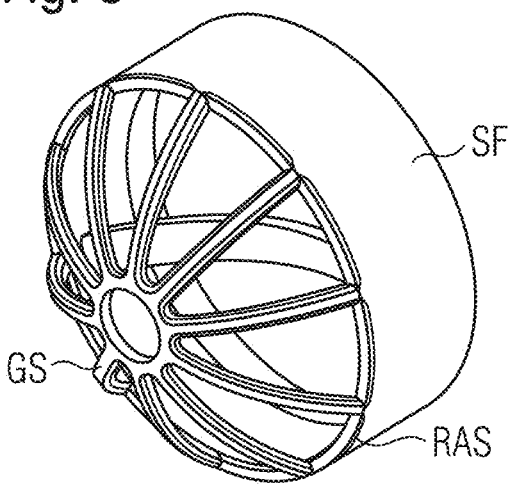
FIG. 3 shows an oblique view of a dirt trap.

The dirt trap SF is shown in FIG. 3 in an oblique view. The dirt trap SF has a pipe section RAS and a grid structure GS and can thus be easily inserted into the connection piece AS5 of the wastewater pipe AWR. The dirt trap is produced via 3D printing. The dirt trap ensures that heavy impurities do not enter the flushing station SS or the collecting tank AB of the flushing station SS, where they could possibly block the siphon SP. By cleaning the dirt trap SF either by means of chemicals or by disassembly and cleaning, the blockage can be easily removed and there is no risk of the siphon SP becoming blocked and water leaking out of the collecting tank AB.

Figure 4:
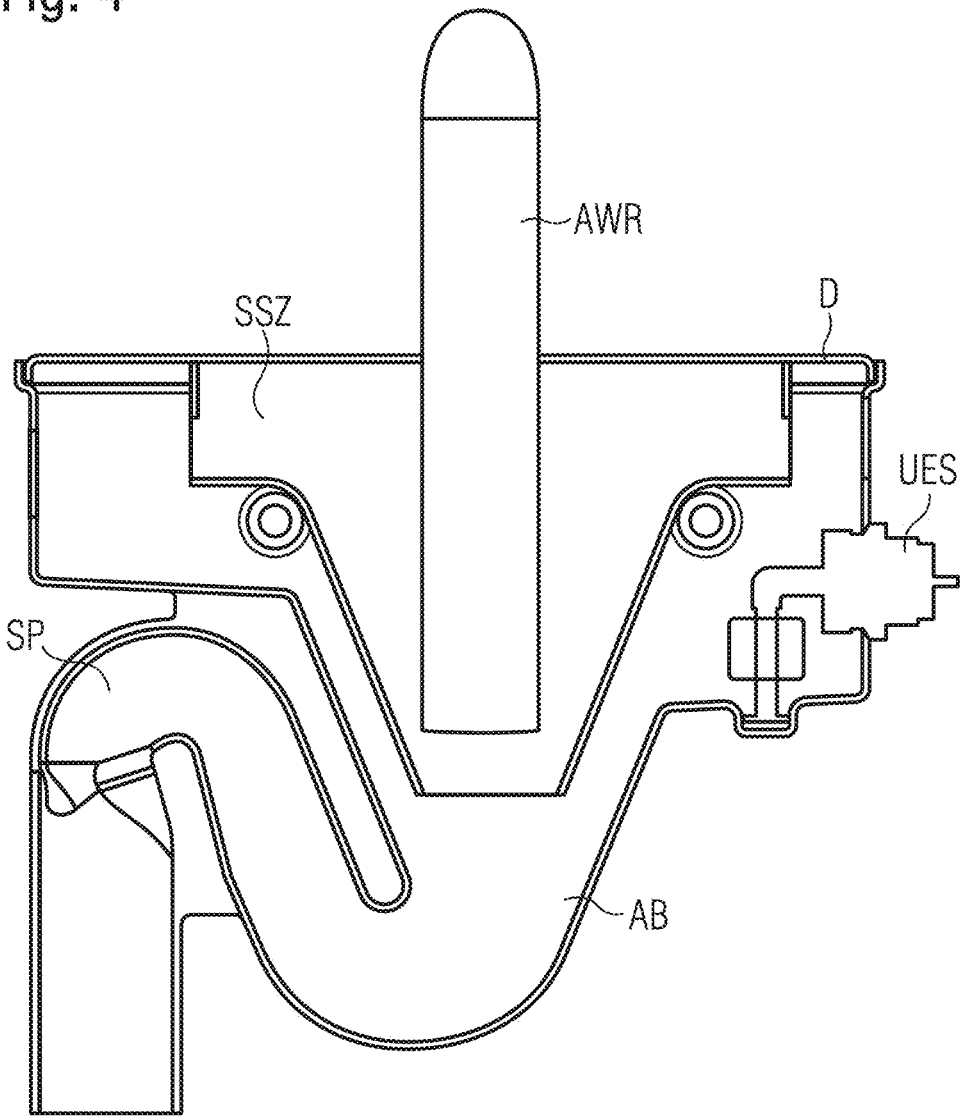
FIG. 4 shows a sectional view of the parts according to FIG. 2 of the flushing station.

FIG. 4 shows a section through the parts according to FIG. 2 of the flushing station SS. The collecting tank AB is funnel-shaped in the direction of the drain. A splash guard SSZ is arranged in the interior of the collecting tank AB, which is also funnel-shaped towards the bottom and is mounted at a distance from the collecting tank AB. The drain pipe AWR opens into the splash guard SSZ at a distance from the splash guard SSZ, as do the pipes L1 and L2 for hot and cold water flushing, which are not shown in FIG. 4.

An overflow sensor UES is arranged in the collecting tank AB, which can detect water accumulating in the collecting tank AB. The overflow sensor UES is coupled to the control unit ST, which closes the electronically actuatable valves V when the overflow sensor UES is triggered and also prevents further triggering of a flush via the sensors S until the cause of the water backing up in the collecting tank AB has been eliminated and the control unit ST has been reset accordingly.

Furthermore, the collecting tank is closed by a lid D through which the wastewater pipe AWR as well as the pipes L1 and L2 open.

Figure 5:
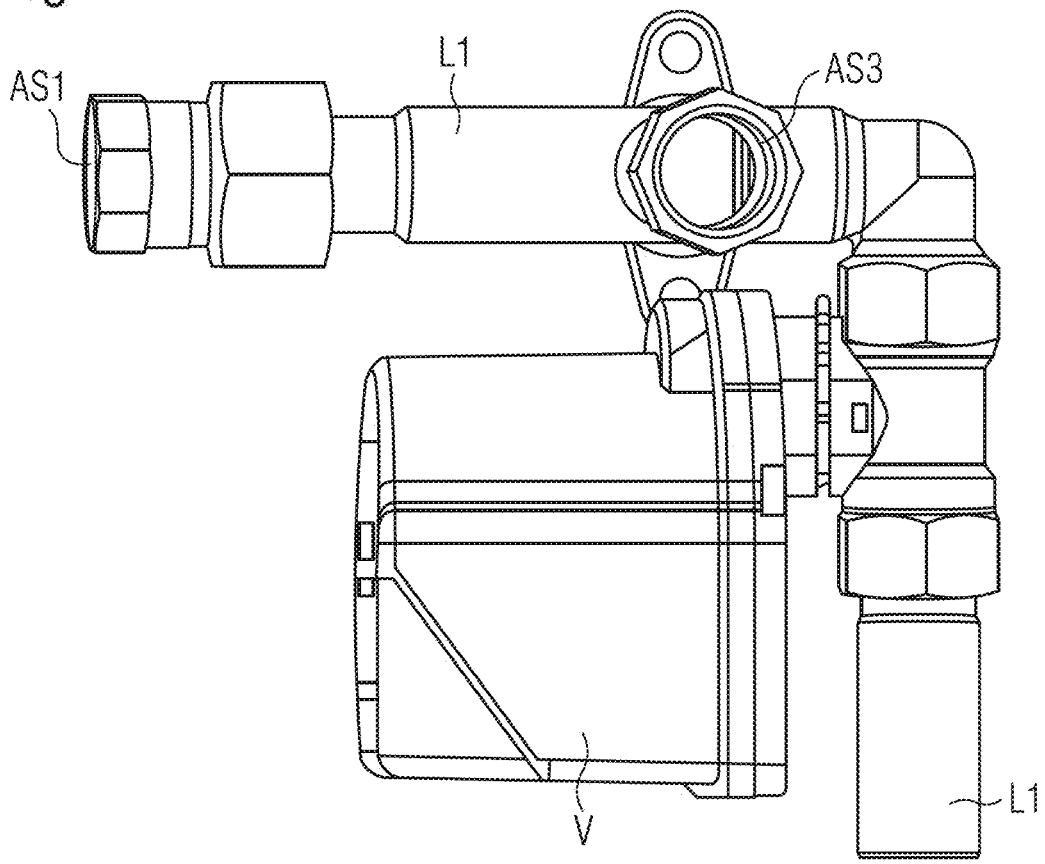
FIG. 5 shows a pipe for establishing a connection to the hot water or cold water connection of the flushing station.

FIG. 5 shows the pipe L1 with the connection piece AS1 for connecting to a hot water pipe and the connection piece AS3 for connecting to the hot water connection of a wash basin. Furthermore, the electronically actuatable valve V is integrated in the pipe L1, by means of which the pipe L1 can be opened for flushing and also closed again. The pipe L1 for the flushing station SS has an L-shape with a horizontal and a vertical section, wherein both the horizontal section and the vertical section can be rotated around their longitudinal axis so that the identical component as shown in FIG. 5 can be used for the pipe L2.

Figure 6:
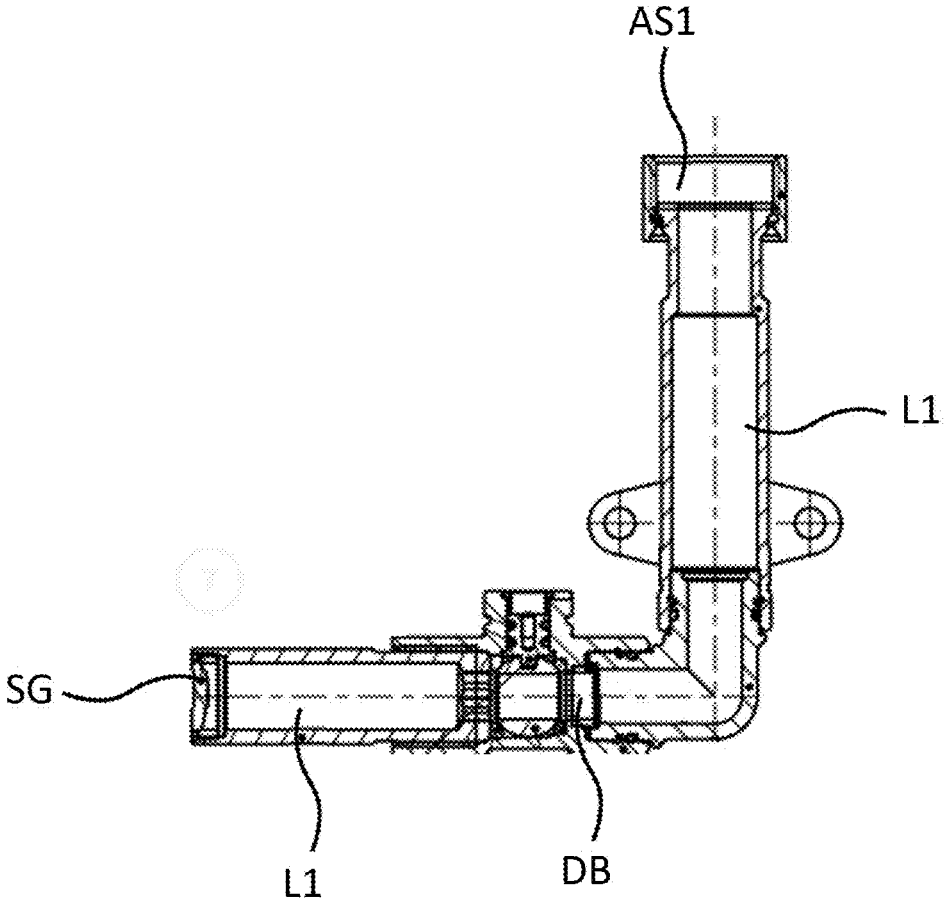
FIG. 6 shows a section through the pipe according to FIG. 5, FIGS. 7A, 7B and 7C show a flow restrictor.

FIG. 6 shows a section through the pipe L1 according to FIG. 5, the electronically actuatable valve V not being shown. A flow restrictor DB and a flow straightener SG are integrated in the pipe L1 in the flow direction from the connection piece AS1 in the direction of the collecting tank AB.

Figure 7A:
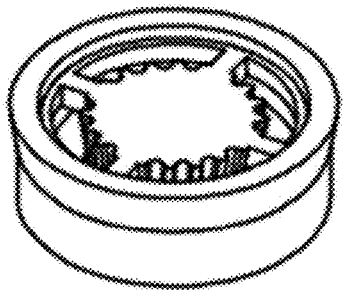
Figure 7B:
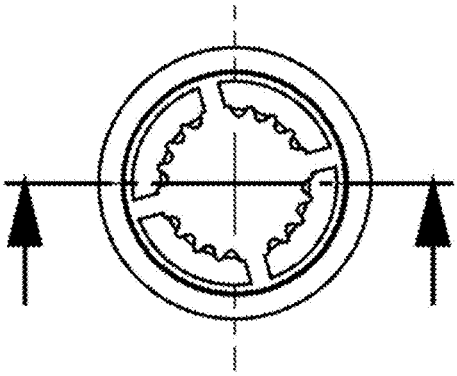
Figure 7C:
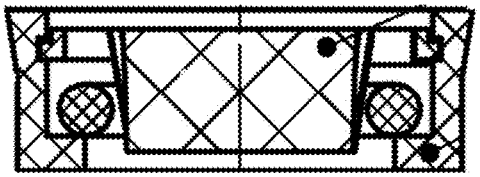

FIG. 7A shows an oblique view of the flow restrictor, FIG. 7B shows a top view of the flow restrictor, and FIG. 7C shows the sectional view indicated in FIG. 7B.

The flow restrictor reduces the flow rate to 16 liters per minute. The flow restrictor DB is a standard component, which can be obtained from the company Neoperl. The flow restrictor DB is inserted upstream of the valve V when mounting the pipe L1.

Figure 8A:
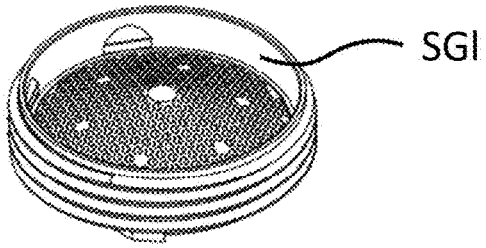
FIGS. 8A and 8B show a flow straightener.
Figure 8B:
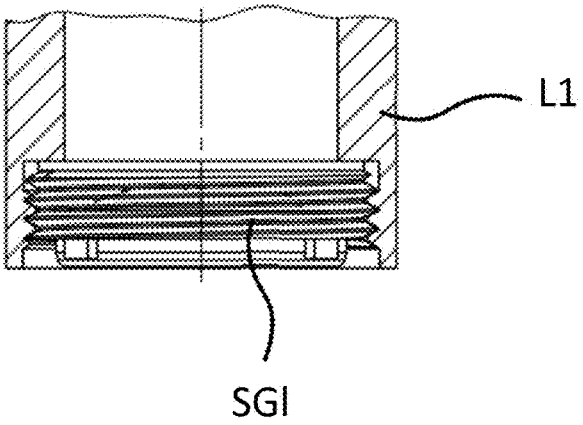

FIG. 8A shows an oblique view of the flow straightener SG, and FIG. 8B shows a sectional view through the lower section of the pipe L1 in which the flow straightener SG is inserted.

The flow straightener is also a component made by the company Neoperl and can be screwed from below into the outlet of the pipe L1 in a corresponding internal thread using an assembly wrench. The flow straightener allows a flow rate of 15 liters per minute and creates a laminar flow.

By integrating the flow restrictor DB and flow straightener SG in the pipe L1, the flow rate is reduced and the water flows laminarly into the splash guard SSZ and then into the collecting tank AB. As a result, greater noise emission is avoided during the flushing process and thus a flushing station with very low noise emission is created.

Figure 9:
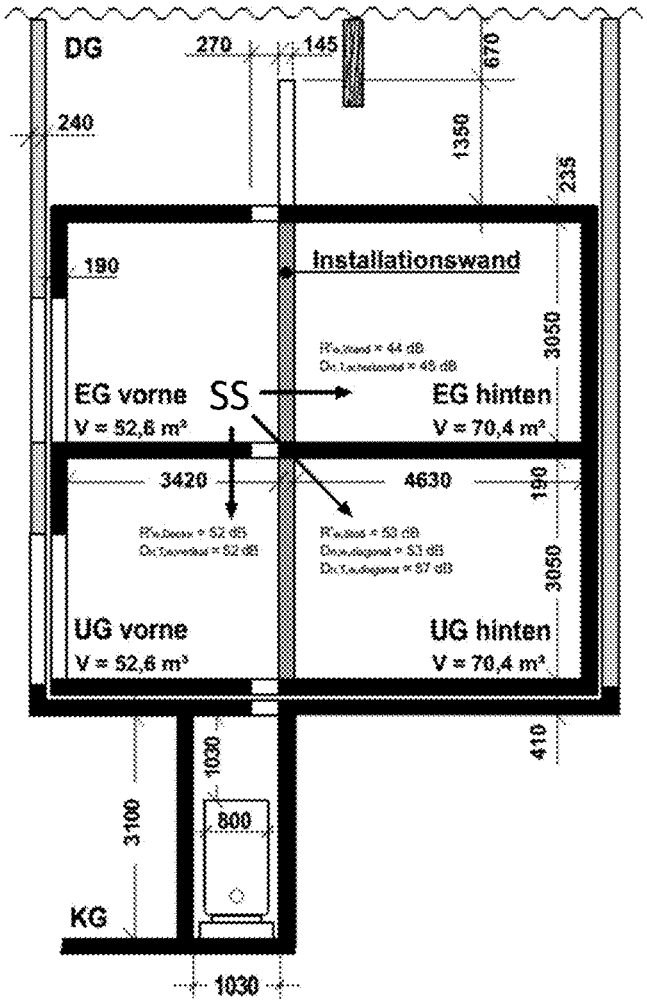
FIG. 9 shows a test setup for measuring the noise emission of the flushing station.

FIG. 9 shows a measurement setup for the flushing station SS according to the invention in order to measure the noise emission in the neighboring rooms as well as in the rooms below or diagonally below. The measurements were carried out by the Fraunhofer Institute in accordance with DIN standard 4109.

Figure 10A:
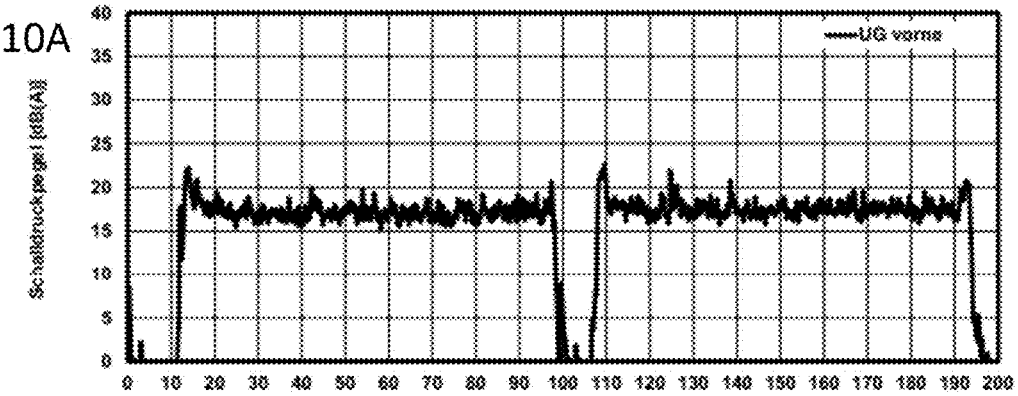
FIGS. 10A, 10B and 10C show the measured noise emissions of the flushing station.
Figure 10B:
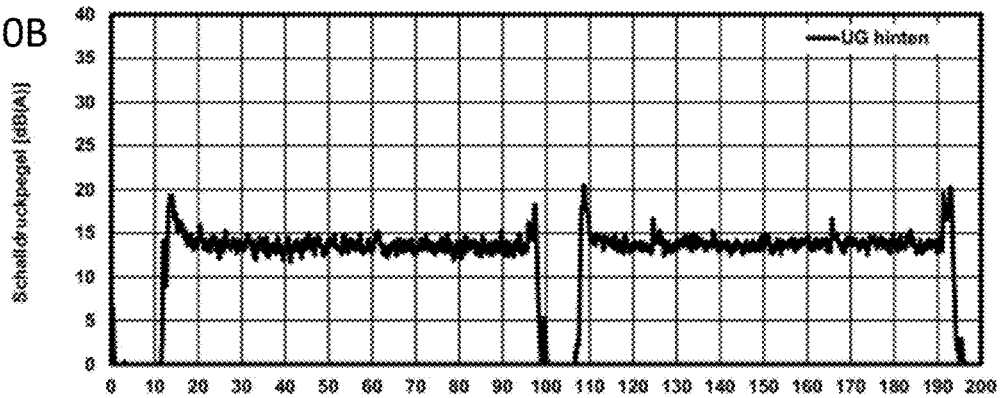
Figure 10C:
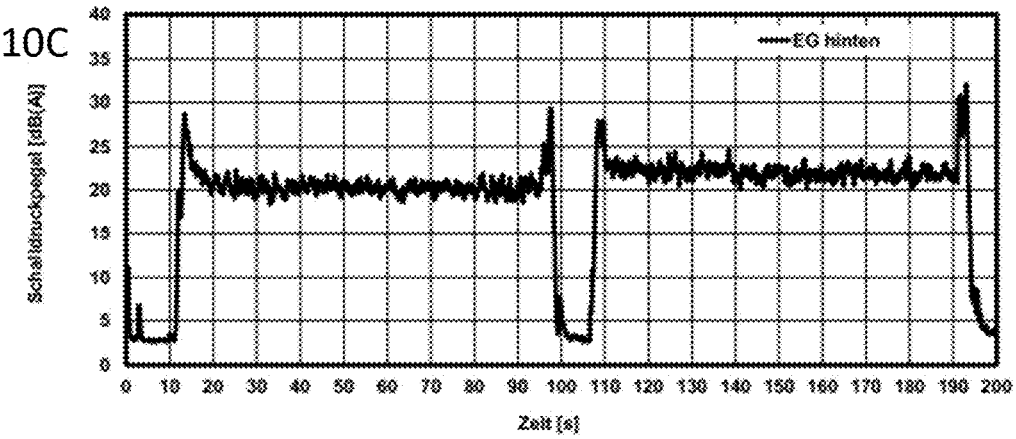

FIG. 10A shows the noise emission during the flushing process in the basement front room. FIG. 10B shows the noise emission in the basement rear room and FIG. 10C the noise emission in the ground floor rear room. In the basement front and basement rear rooms, the noise emission is approximately 20 and 15 decibels respectively, and in the ground floor rear room, i.e. adjacent to the room with the flushing station SS, the noise emission is 20 and just over 20 decibels respectively. Thus, the requirements according to DIN 4109-5, which requires a noise emission of less than 25 decibels, and also according to VDE 4100 SSt III, which requires an emission of less than 22 decibels, are met.

Figure 11:
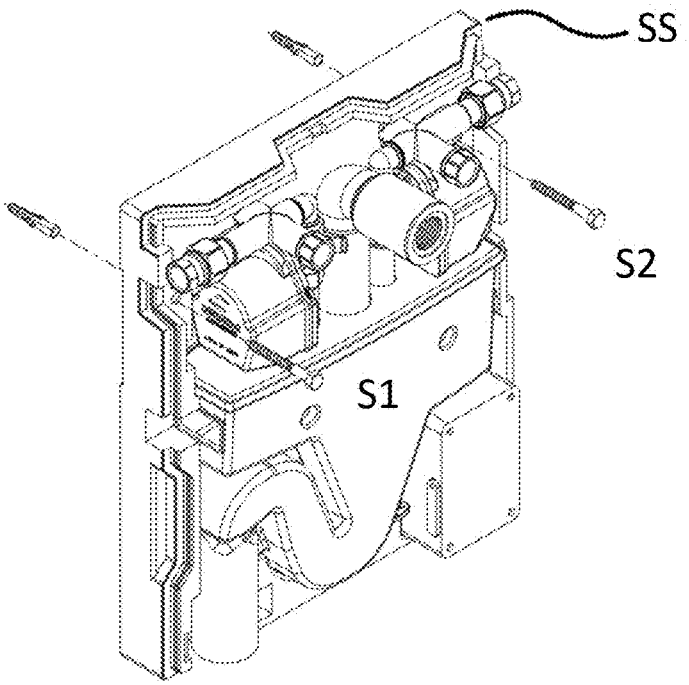
FIG. 11 shows an oblique view of the opened flushing station for wall mounting.

FIG. 11 shows the flushing station SS in wall mounting by means of two screws S1 and S2.

Figure 12:
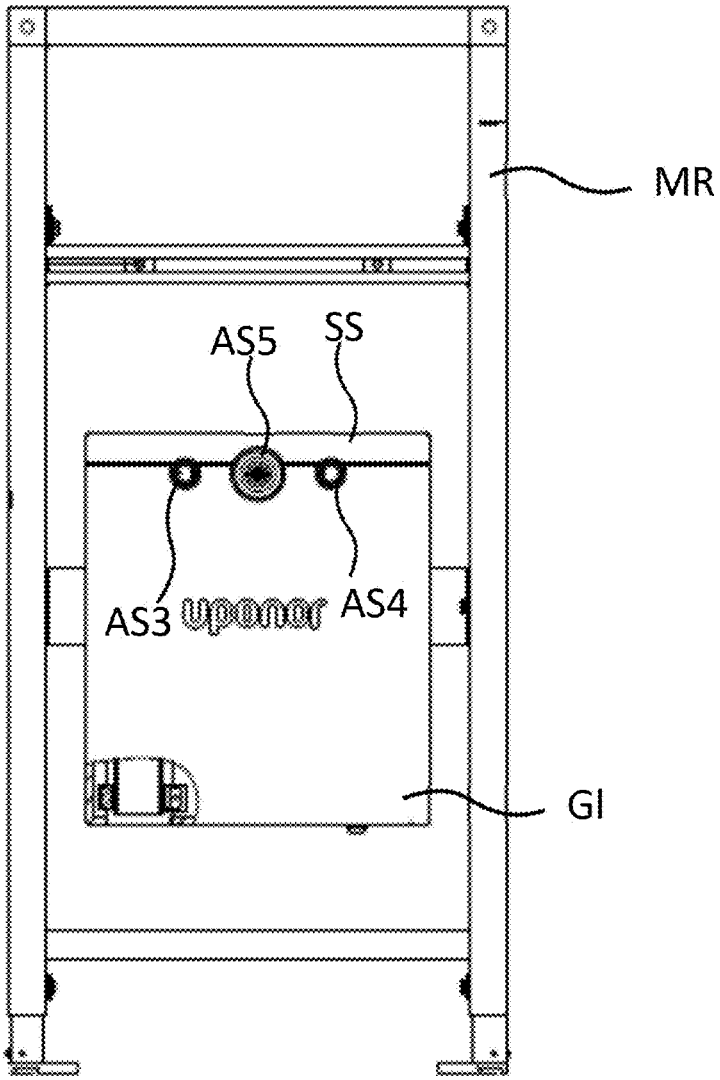
FIG. 12 shows a front view of the flushing station mounted in a mounting frame.

FIG. 12 shows a mounting frame MR in which the flushing station can also be mounted. FIG. 12 also shows that the flushing station is completely surrounded by the housing G, which also contributes to a certain degree to noise reduction. Only the connection pieces AS3 and AS4 for the cold and hot water connection of the wash basin and AS5 for the wastewater connection of the wash basin protrude from the housing. The connections AS1 and AS2 (not visible in FIG. 12) for the hot and cold water pipes also protrude from the sides.

Both mounting options allow for a very space-saving installation of the flushing station SS, since the designated connection space for a wash basin is used.

By using the flow restrictor DB and the flow straightener SG from Neoperl in the pipes L1 and L2 of the flushing station SS, the extremely important noise reduction of the flushing station SS is achieved. This means that flushing processes can also take place in hotels, for example, without disturbing guests who are asleep at this time of day.

LIST OF REFERENCE SIGNS

SS flushing station
AS1 to AS5 connection pieces
AB collecting tank
SP siphon
L1, L2 pipes
S sensor
ST control unit
V valve
SG flow straightener
DB flow restrictor
G housing
SSZ splash guard
AB collecting tank
UES overflow sensor
AWR wastewater pipe
SF dirt trap D lid
S1, S2 screws
MR mounting frame
The invention claimed is:

1. A flushing station comprising:
a connection piece for a hot water pipe;
a connection piece for a cold water pipe;
a collecting tank with a siphon for draining water;
pipes at the connection pieces which conduct the water from the connection pieces into the collecting tank;
at least one sensor per pipe;
a control unit connected to the sensors connected to the pipes; and
valves, each respective valve being actuatable in a respective pipe of the pipes;
wherein the control unit is coupled to each respective valve and the valves can be individually opened by the control unit for flushing one or more of the hot water pipe and the cold water pipe,
wherein a flow restrictor and a flow straightener are integrated in each of the pipes, and
wherein the flow restrictor limits the amount of water and the flow straightener creases a laminar flow.

2. The flushing station according to claim 1, wherein the flow restrictor is designed for a water flow rate of 16 liters per minute and the flow straightener is designed for a water flow rate of 15 liters per minute.

3. The flushing station according to claim 1, wherein the flow restrictor is arranged upstream of the flow straightener in a flow direction of the water through the pipes.

4. The flushing station according to claim 1, wherein each respective valve is designed as a ball valve.

5. The flushing station according to claim 1, wherein the flushing station further comprises a housing made of expanded polypropylene and only the connection pieces are guided through the housing.

6. The flushing station according to claim 1, wherein the flushing station further comprises a splash guard arranged in the collecting tank, into which the pipes open.

7. The flushing station according to claim 6, wherein the collecting tank is funnel-shaped towards the siphon and the splash guard is also funnel-shaped and is mounted in a funnel-shaped region at a distance from the collecting tank.

8. The flushing station according to claim 1, wherein the flushing station further comprises an overflow sensor arranged in the collecting tank, which, when triggered, causes a closing of the valves and blocking of further flushing in the control unit.

9. The flushing station according to claim 1, wherein the connection pieces are formed laterally opposite each other on the flushing station.

10. The flushing station according to claim 1, wherein each of the pipes is L-shaped, such that an identically shaped pipe can be used to conduct the water from the connection pieces.

11. The flushing station according to claim 1, wherein one pipe of the pipes has a hot water inlet and another pipe of the pipes has a cold water inlet, such that the hot water inlet and the cold water inlet are respectively configured to connect to a hot water connection and a cold water connection of a wash basin.

12. The flushing station according to claim 6, wherein another connection piece is formed on a wastewater pipe, which also opens into the collecting tank and into the splash guard.

13. The flushing station according to claim 12, wherein the flushing station further comprises a dirt trap in the wastewater pipe.

14. The flushing station according to claim 13, wherein the dirt trap is produced by 3D printing.

* * * * *